US008661766B2

(12) United States Patent
Hohmann, Jr.

(10) Patent No.: US 8,661,766 B2
(45) Date of Patent: Mar. 4, 2014

(54) ANCHOR WITH ANGULAR ADJUSTMENT

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 6 days.

(21) Appl. No.: 13/531,196

(22) Filed: Jun. 22, 2012

(65) Prior Publication Data

US 2013/0340378 A1 Dec. 26, 2013

(51) Int. Cl.
*E04B 1/38* (2006.01)
*E04C 5/00* (2006.01)

(52) U.S. Cl.
USPC ..... 52/705

(58) Field of Classification Search
USPC ..... 52/698, 699, 700, 701, 702, 703, 704, 52/705, 706, 707, 708, 709, 710, 711, 712, 52/713, 714, 715
See application file for complete search history.

(56) References Cited

U.S. PATENT DOCUMENTS

| | | | |
|---|---|---|---|
| 1,392,703 | A | 10/1921 | Phillips |
| 1,798,468 | A | 3/1931 | Hartzler et al. |
| 1,854,633 | A | 4/1932 | Stephens |
| 1,942,863 | A | 1/1934 | Johnstone |
| 2,058,148 | A | 10/1936 | Hard |
| 2,130,531 | A | 9/1938 | Arand |
| 2,240,117 | A | 4/1941 | Homolya |
| 2,280,647 | A | 4/1942 | Hawes |
| 2,403,566 | A | 7/1946 | Thorp et al. |
| 2,580,330 | A | 12/1951 | Symons |
| 2,948,045 | A | 8/1960 | Imonetti |
| 2,966,705 | A | 1/1961 | Massey |
| 2,999,571 | A | 9/1961 | Huber |
| 3,277,626 | A | 10/1966 | Brynjolfsson et al. |
| 3,292,336 | A | 12/1966 | Brynjolfsson et al. |
| 3,309,828 | A | 3/1967 | Tribble |
| 3,341,998 | A | 9/1967 | Lucas |
| 3,353,312 | A | 11/1967 | Storch |
| 3,377,764 | A | 4/1968 | Storch |
| 3,494,090 | A | 2/1970 | Allen |

(Continued)

FOREIGN PATENT DOCUMENTS

| | | | |
|---|---|---|---|
| CA | 2502978 | C | 1/2009 |
| CH | 279209 | A | 11/1951 |

(Continued)

OTHER PUBLICATIONS

ASTM WK 2748, Leakage Air Barrier Assemblies, Jan. 2005.

(Continued)

*Primary Examiner* — Mark Wendell
*Assistant Examiner* — Keith Minter
(74) *Attorney, Agent, or Firm* — Silber & Fridman

(57) ABSTRACT

A wall anchor for use in an insulated cavity wall has an elongated body extending from a driven end to a driving end. The driven end is adapted to be mounted on an inner wythe of a cavity wall structure. A rotation control portion of the elongated body may include teeth formed on the surface. A collar with at least one aperture for a veneer tie is located near the driving end. The collar may have a pawl associated with it and positioned to engage the teeth on the elongated body. The teeth of the elongated body and the pawl of the collar form a ratchet structure. The collar can be rotated relative to the wall anchor only in a single direction, with the interengaging ratchet structure preventing rotation in the opposite direction.

17 Claims, 12 Drawing Sheets

(56) References Cited

U.S. PATENT DOCUMENTS

| | | | |
|---|---|---|---|
| 3,500,713 | A | 3/1970 | Bell |
| 3,523,395 | A | 8/1970 | Rutter et al. |
| 3,587,198 | A | 6/1971 | Hensel |
| 3,707,815 | A | 1/1973 | Molyneux |
| 3,786,605 | A | 1/1974 | Winfrey |
| 3,964,226 | A | 6/1976 | Hala et al. |
| 4,002,001 | A | 1/1977 | Uydess |
| 4,021,990 | A | 5/1977 | Schwalberg |
| 4,107,890 | A | 8/1978 | Seghezzi et al. |
| 4,108,560 | A | 8/1978 | Minogue |
| D259,171 | S | 5/1981 | Wallace |
| 4,305,239 | A | 12/1981 | Geraghty |
| 4,329,823 | A | 5/1982 | Simpson |
| 4,350,464 | A | 9/1982 | Brothers |
| 4,373,314 | A | 2/1983 | Allan |
| 4,422,617 | A | 12/1983 | Gallis |
| 4,426,061 | A | 1/1984 | Taggart |
| 4,430,035 | A | 2/1984 | Rodseth |
| 4,438,611 | A | 3/1984 | Bryant |
| 4,473,209 | A | 9/1984 | Gallis et al. |
| 4,473,984 | A | 10/1984 | Lopez |
| 4,596,102 | A | 6/1986 | Catani et al. |
| 4,598,518 | A | 7/1986 | Hohmann |
| 4,600,344 | A | 7/1986 | Sutenbach et al. |
| 4,606,163 | A | 8/1986 | Catani |
| 4,653,244 | A | 3/1987 | Farrell |
| 4,660,342 | A | 4/1987 | Salisbury |
| 4,680,913 | A | 7/1987 | Geisen et al. |
| 4,736,554 | A | 4/1988 | Tyler |
| 4,764,069 | A | 8/1988 | Reinwall et al. |
| 4,825,614 | A | 5/1989 | Bennett et al. |
| 4,852,320 | A | 8/1989 | Ballantyne |
| 4,869,038 | A | 9/1989 | Catani |
| 4,869,043 | A | 9/1989 | Hatzinikolas et al. |
| 4,875,319 | A | 10/1989 | Hohmann |
| 4,955,172 | A | 9/1990 | Pierson |
| 4,970,842 | A | 11/1990 | Kappeler et al. |
| 5,012,624 | A | 5/1991 | Dahlgren |
| 5,016,855 | A | 5/1991 | Huggins |
| 5,063,722 | A | 11/1991 | Hohmann |
| 5,207,043 | A | 5/1993 | McGee et al. |
| 5,209,619 | A | 5/1993 | Rinderer |
| 5,347,781 | A | 9/1994 | Hanlon |
| 5,392,581 | A | 2/1995 | Hatzinikolas et al. |
| 5,408,798 | A | 4/1995 | Hohmann |
| 5,433,569 | A | 7/1995 | Fall et al. |
| 5,439,338 | A | 8/1995 | Rosenberg |
| 5,454,200 | A | 10/1995 | Hohmann |
| 5,456,052 | A | 10/1995 | Anderson et al. |
| D373,623 | S | 9/1996 | Mathison |
| 5,634,310 | A | 6/1997 | Hohmann |
| 5,644,889 | A | 7/1997 | Getz |
| 5,671,578 | A | 9/1997 | Hohmann |
| RE35,659 | E | 11/1997 | Ernst et al. |
| 5,806,275 | A | 9/1998 | Giannuzzi et al. |
| 5,816,008 | A | 10/1998 | Hohmann |
| 5,836,126 | A | 11/1998 | Harkenrider et al. |
| D406,524 | S | 3/1999 | Steenson et al. |
| 6,128,883 | A | 10/2000 | Hatzinikolas |
| 6,131,360 | A | 10/2000 | Dalen |
| 6,209,281 | B1 | 4/2001 | Rice |
| 6,279,283 | B1 | 8/2001 | Hohmann et al. |
| 6,332,300 | B1 | 12/2001 | Wakai |
| 6,345,472 | B1 | 2/2002 | Taylor |
| 6,401,406 | B1 | 6/2002 | Komara |
| 6,502,362 | B1 | 1/2003 | Zambelli et al. |
| 6,668,505 | B1 | 12/2003 | Hohmann et al. |
| 6,763,640 | B2 | 7/2004 | Lane |
| 6,789,365 | B1 | 9/2004 | Hohmann et al. |
| 6,802,675 | B2 | 10/2004 | Timmons et al. |
| 6,925,768 | B2 | 8/2005 | Hohmann et al. |
| 6,941,717 | B2 | 9/2005 | Hohmann et al. |
| 7,017,318 | B1 | 3/2006 | Hohmann et al. |
| D530,796 | S | 10/2006 | Zielke et al. |
| 7,114,900 | B2 | 10/2006 | Toosky |
| 7,334,374 | B2 | 2/2008 | Schmid |
| 7,404,274 | B2 | 7/2008 | Hayes |
| 7,415,803 | B2 | 8/2008 | Bronner |
| 7,421,826 | B2 | 9/2008 | Collins et al. |
| 7,562,506 | B2 | 7/2009 | Hohmann, Jr. |
| D603,251 | S | 11/2009 | King |
| 7,717,015 | B2 | 5/2010 | Nilsen et al. |
| D625,977 | S | 10/2010 | Watson et al. |
| 7,845,137 | B2 | 12/2010 | Hohmann, Jr. |
| D658,046 | S | 4/2012 | Austin, III |
| D672,639 | S | 12/2012 | Pawluk |
| 2002/0100239 | A1 | 8/2002 | Lopez |
| 2005/0279043 | A1 | 12/2005 | Bronner |
| 2006/0198717 | A1 | 9/2006 | Fuest |
| 2008/0141605 | A1 | 6/2008 | Hohmann |
| 2009/0133357 | A1 | 5/2009 | Richards |
| 2010/0037552 | A1 | 2/2010 | Bronner |
| 2011/0047919 | A1 | 3/2011 | Hohmann, Jr. |
| 2011/0146195 | A1 | 6/2011 | Hohmann, Jr. |
| 2011/0173902 | A1 | 7/2011 | Hohmann, Jr. et al. |
| 2012/0291390 | A1 | 11/2012 | Hohmann, Jr. |
| 2012/0304576 | A1 | 12/2012 | Hohmann, Jr. |

FOREIGN PATENT DOCUMENTS

| | | |
|---|---|---|
| DE | 231696 | 6/1909 |
| DE | 1960453 | 6/1970 |
| DE | 2856205 A1 | 7/1980 |
| GB | 2069024 | 8/1981 |

OTHER PUBLICATIONS

Building Envelope Requirements, 780 CMR sec. 1304.3 of Chaper 13; Boston, MA, Jan. 1, 2001.

Wire Bond Corp, "Wire-Bond Sure Tie" and "Wire-Bond Clip". Product Catalog Sheet (Charlotte, NC, undated).

Heckmann Building Products, Inc. Pos-I-Tie Air Infiltration and Water Penetration Test, Aug. 2003. htt;://www.heckman-nbuildingprods.com/PPosTest.htm.

Heckmann Building Products, Inc. "Wing Nut Pos-I-Tie." Product Catalogue Sheet. (Melrose Park, IL, undated).

www.heckmanbuildingprods.com, Heckman General Catalog for 2006, Oct. 28, 2006 pp. 4-5.

ANCHOR WITH ANGULAR ADJUSTMENT

FIELD OF THE INVENTION

The present invention generally relates to anchoring systems for insulated cavity walls, and more specifically, a wall anchor that is adjustable for proper positioning of a veneer tie.

BACKGROUND OF THE INVENTION

Anchoring systems for cavity walls are used to secure veneer facings to a building and overcome seismic and other forces, e.g. wind shear, etc. Anchoring systems generally include a wall anchor for insertion into an inner wythe of a cavity wall structure and a veneer tie that is embedded in a mortar joint of an outer wythe or brick veneer. Slight angular and height misalignments in an installed veneer tie can reduce the ability of the anchoring system to transfer tension and compression loads acting on the outer wythe to the backup wall. However, a freely adjustable anchoring system is not preferable, because of the risk of unintentional movement of the anchor prior to connection to the veneer tie.

SUMMARY OF THE INVENTION

In one aspect, a wall anchor for use in a cavity wall to connect to a veneer tie to join an inner wythe and an outer wythe of the cavity wall generally includes an elongated body having a driven end, a driving end, and a longitudinal axis. A collar is mounted on the elongated body for rotation about the longitudinal axis of the elongated body. The collar is adapted for connection to the veneer tie. A rotation control structure operatively engages the collar and elongate body. The rotation control structure permits rotation of the collar in a first direction relative to the elongate body about the longitudinal axis of the elongate body. The rotation control structure prevents rotation of the collar relative to the elongate body about the longitudinal axis of the elongate body in a second direction opposite the first direction. The rotation control structure comprises ratchet teeth associated with one of the elongate body and the collar and a pawl associated with the other of the elongate body and the collar.

In another aspect, a wall anchor for use in a cavity wall to connect to a veneer tie to join an inner wythe and an outer wythe of the cavity wall generally includes an elongated body having a driven end, a driving end and a longitudinal axis. The driven end is adapted to be threadably mounted on the inner wythe of the cavity wall. The elongated body includes a rotation control portion having ratchet teeth formed thereon. A collar is disposed on the elongated body and received on the rotation control portion. The collar has wings, each wing having an aperture therein to receive a respective portion of the veneer tie. The collar comprises a first metal plate and a second metal plate. A pawl associated with the collar projects from the collar into engagement with the ratchet teeth. The pawl and ratchet teeth are positioned and configured for engagement with each other for permitting rotation of the collar about the longitudinal axis of the elongated body in a first direction and preventing rotation of the collar about the longitudinal axis of the elongated body in a second direction opposite the first direction.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
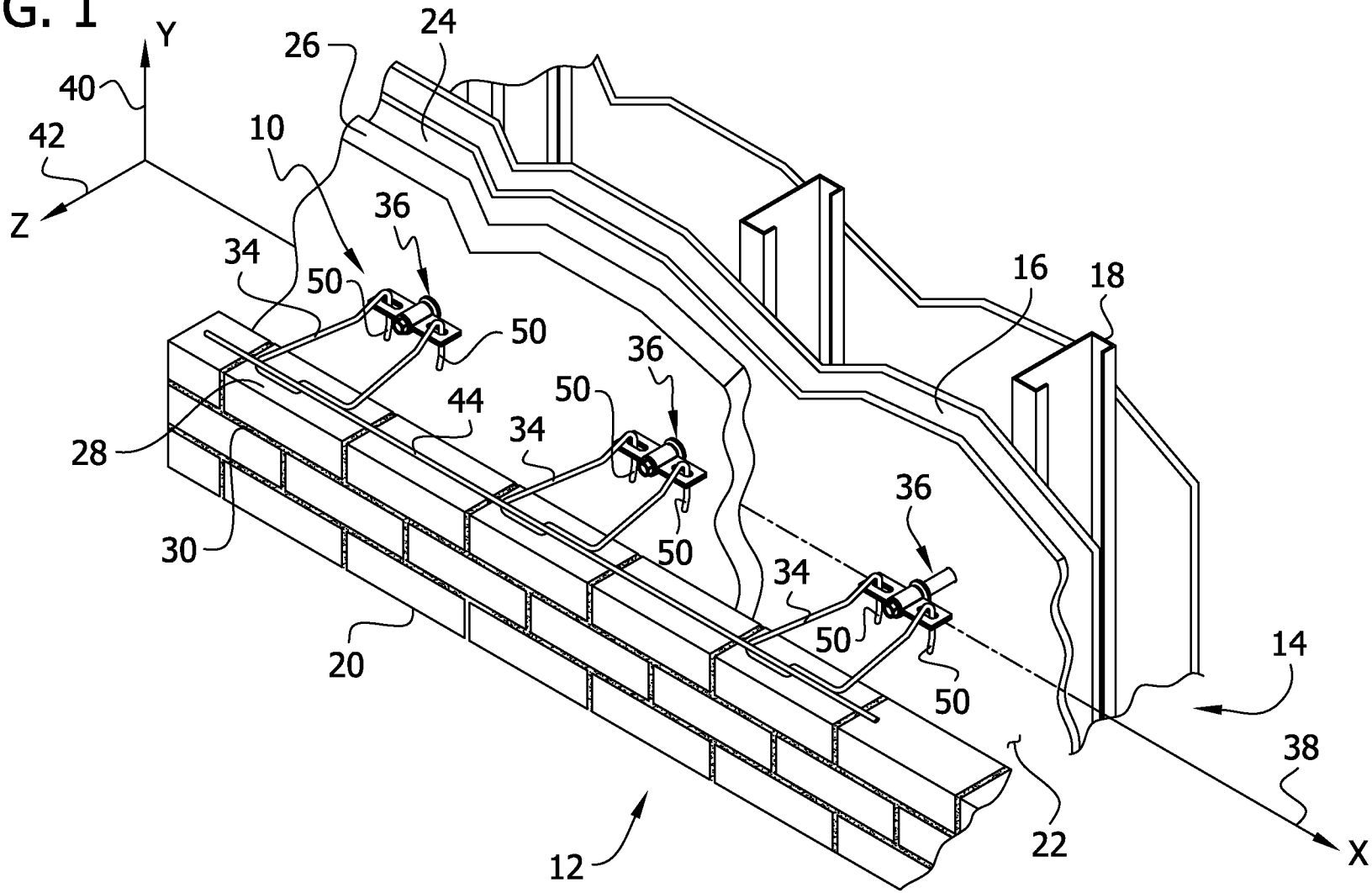
FIG. 1 is a perspective of an anchoring system as applied to a cavity wall with an inner wythe of an insulated dry wall construction and an outer wythe of brick.

Referring to FIG. 1, an anchoring system for cavity walls is indicated generally at 10. A cavity wall structure generally indicated at 12 comprises an inner wythe or drywall backup 14 with sheetrock or wallboard 16 mounted on metal columns or studs 18 and an outer wythe or facing wall 20 of brick construction. Between the inner wythe 14 and the outer wythe 20, a cavity 22 is formed. An air/vapor barrier 24 and insulation 26 are attached to an exterior surface of the inner wythe 14. The construction of the inner and outer wythes may be other than described without departing from the scope of the present invention.

Successive bed joints 28 and 30 are substantially planar and horizontally disposed and, in accordance with building standards, are approximately 0.375 inches in height in the a typical embodiment. Selective ones of bed joints 28 and 30, which are formed between courses of bricks, are able to receive the insertion portion of a veneer tie 34. A wall anchor 36 is threadedly mounted on the inner wythe 14 and is supported by the inner wythe. The wall anchor generally indicated at 36, as described in greater detail below, is adjustable to accommodate the veneer tie 34 and preferably is also configured to minimize air and moisture penetration around the wall anchor/inner wythe interface.

For purposes of the description, the cavity surface defined by the outer surface of the vapor barrier 24 of the inner wythe 14 contains a horizontal line or x-axis 38 and intersecting vertical line or y-axis 40. A horizontal line or z-axis 42, normal to the xy-plane, passes through the coordinate origin formed by the intersecting x- and y-axes.

In the illustrated embodiment, the anchoring system 10 includes wall anchor 36, veneer tie 34, and a wire or outer wythe reinforcement 44. At intervals along the exterior surface of the barrier 24 of the inner wythe 14, wall anchors 36 are driven into place in anchor-receiving channels 46 (see FIG. 2). Anchor-receiving channels 46 can be pre-drilled, or, alternatively, wall anchor 36 can be used to drill its own channel. The wall anchors 36 are positioned so that a longitudinal axis 48 of wall anchor 36 is generally normal to the xy-plane and taps into stud 18. Veneer tie 34 is shown in FIG. 1 as being placed on a course of bricks in preparation for being embedded in the mortar of bed joint 28. The veneer tie 34 is formed of wire and includes pintle connectors 50, as is known in the art. The wire reinforcement 44 is also constructed of a wire, as is known in the art, and preferably conforms to the joint reinforcement requirements of ASTM Standard Specification A951-00, Table 1.

Figure 3:
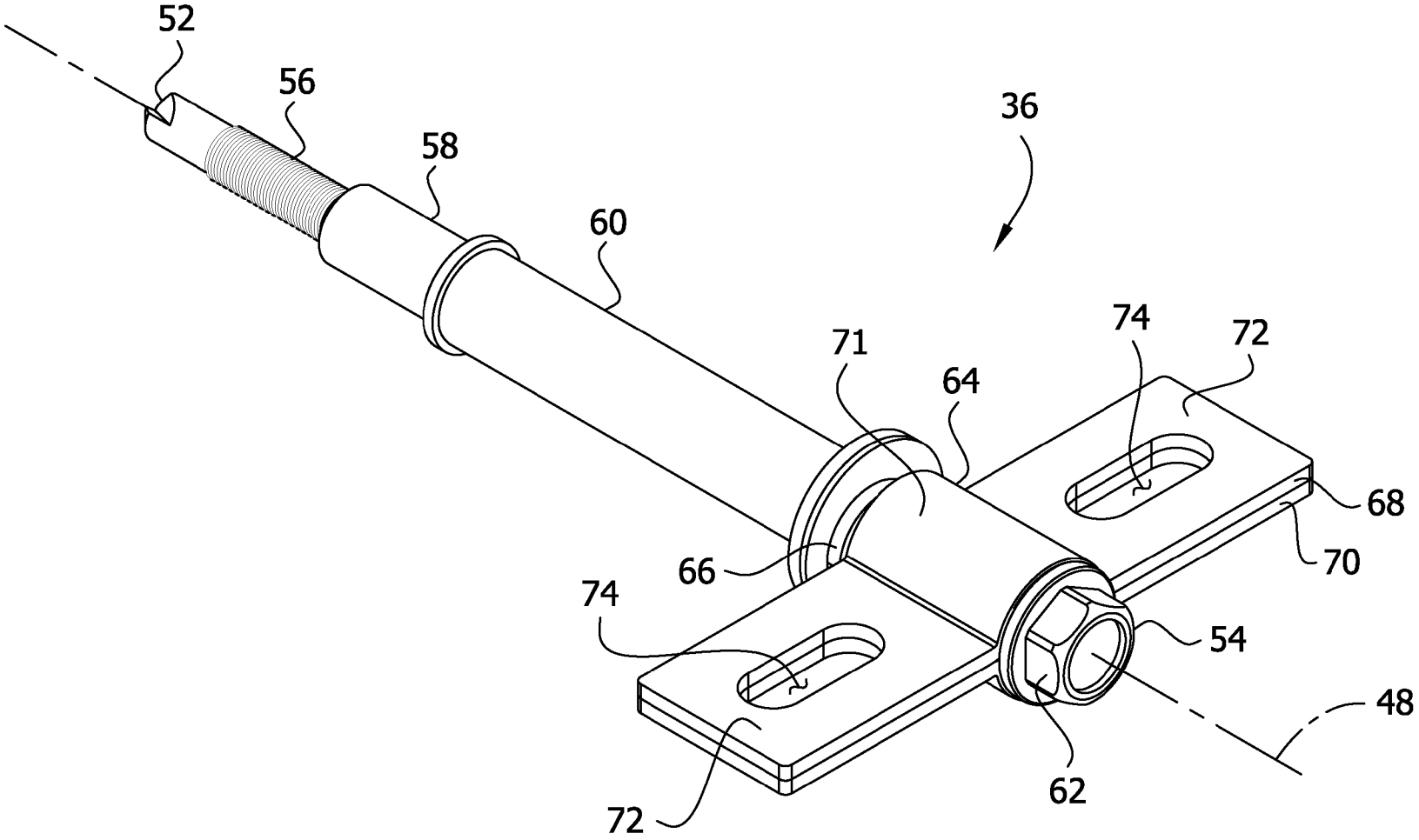
FIG. 3 is a perspective of an anchor with angular adjustment according to a first embodiment of the present invention.
Figure 4:
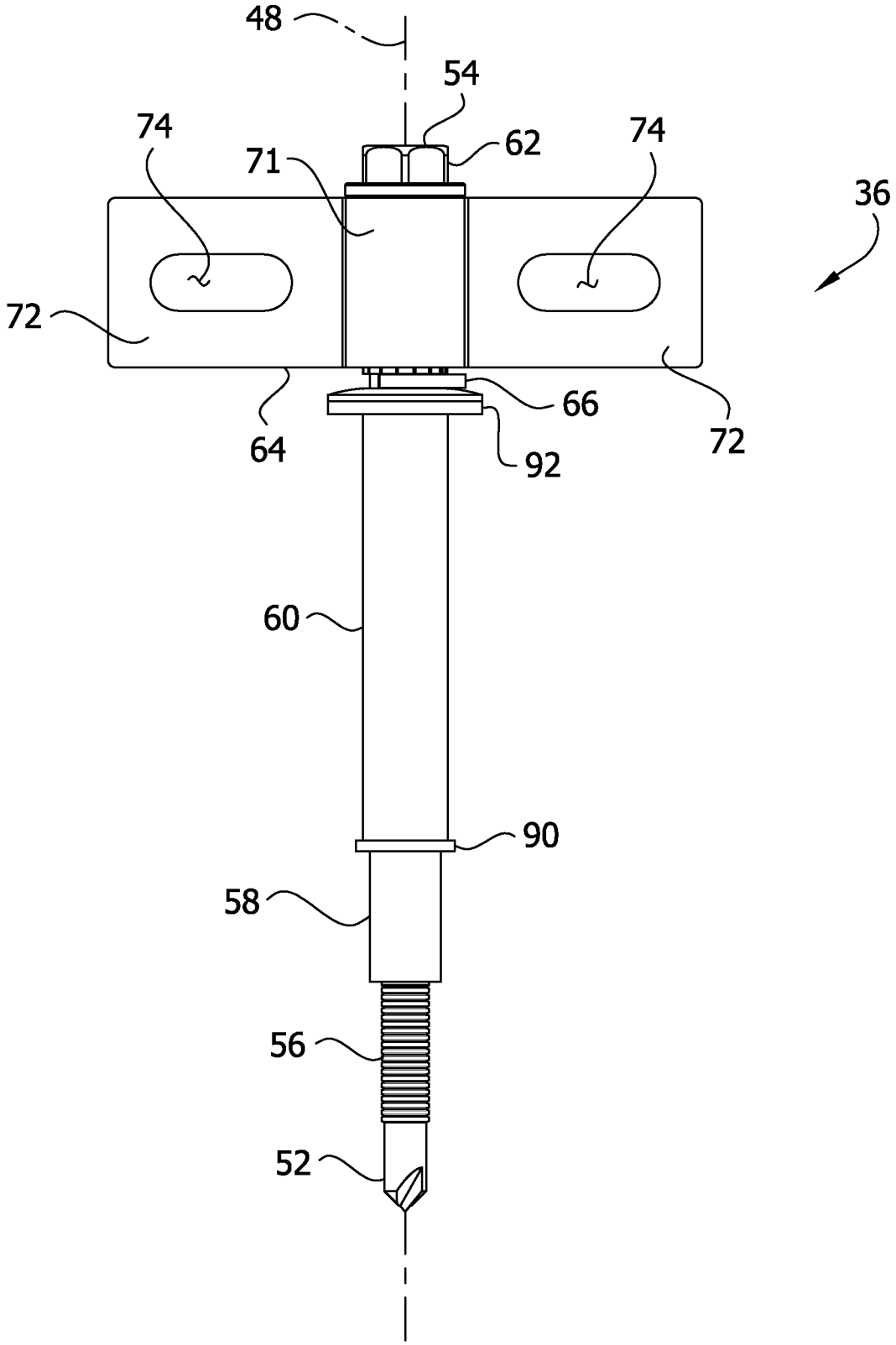
FIG. 4 is a top view thereof.
Figure 5:
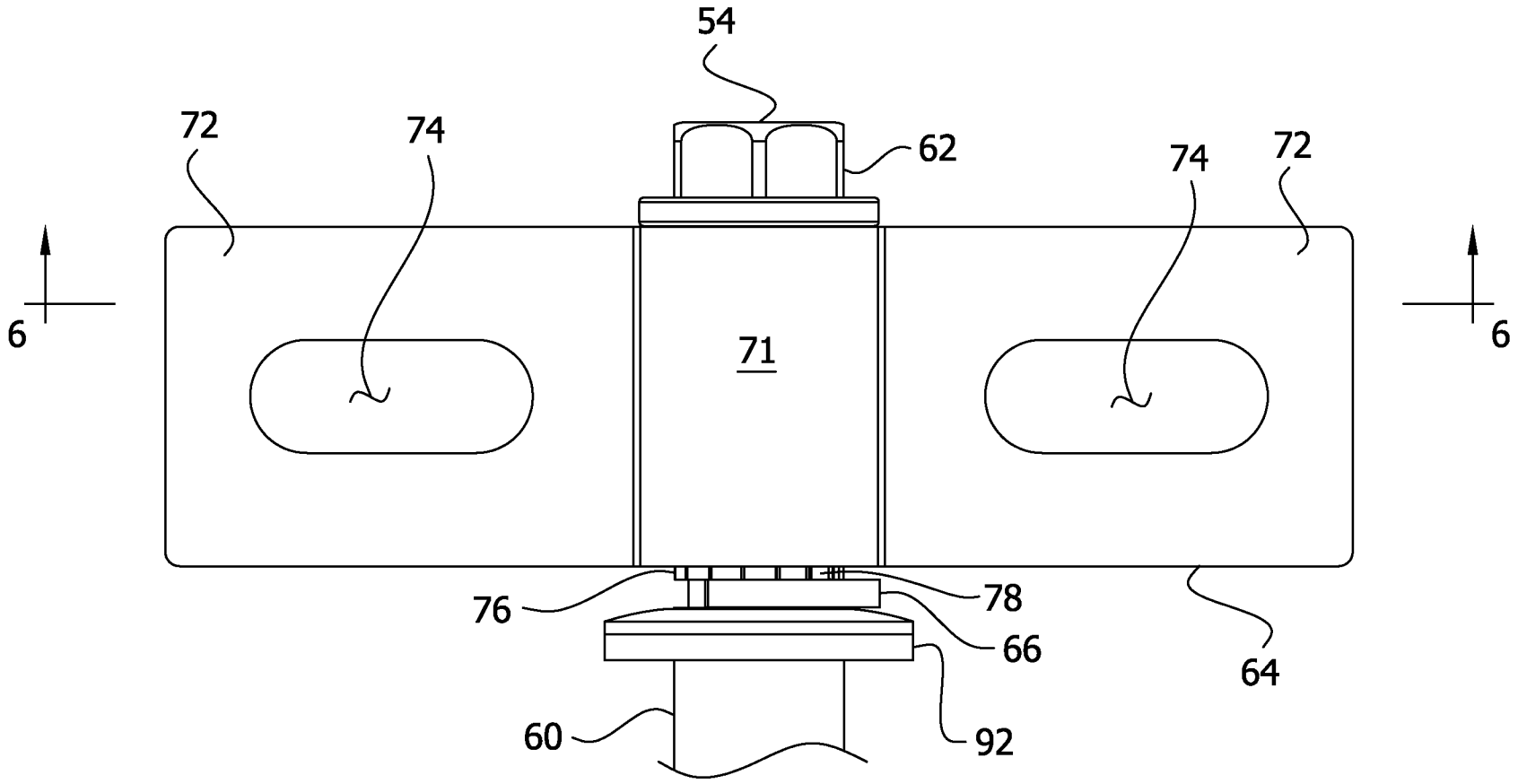
FIG. 5 is an enlarged, fragmentary view of the anchor of FIG. 4.

As shown in FIG. 3, the wall anchor 36 includes an elongate body or shaft that extends along a longitudinal axis 48 of the anchor from a driven end 52 to a driving end 54. The driven end 52 includes a threaded portion 56. In use, the driven end 52 is driven into stud 18, mounting the wall anchor 36 on the inner wythe 14. In the preferred embodiment, the elongated body of the wall anchor 36 includes a dual-diameter barrel with a smaller diameter first shaft portion 58 toward the driven end 52 and a larger diameter second shaft portion 60 toward the driving end 54.

A drive head 62 is located at the driving end 54 of the anchor 36. As illustrated, the drive head 62 is a bolt capable of being driven using a conventional chuck, and secures a wing nut or collar 64 onto the anchor 36. Collar 64 is disposed on the anchor 36 near the driving end 54, adjacent the drive head 62. A lock washer 66 holds the collar 64 in place on the elongated body. The collar 64 includes two plates 68, 70 secured together, such as by welding or other conventional means. Each of the plates is preferably made of metal or other suitable material. Other constructions of the collar, such as a collar formed from one plate or more than two plates, are within the scope of the present invention. The collar 64 includes a central barrel 71 and two wings 72 extending in opposite directions from the barrel. Each wing defines an aperture 74 for receiving a respective one of the pintle connectors 50 of the veneer tie 34. The collar may have any number of wings, but generally one or two is most practical. As shown, the pintle connectors 50 of the veneer tie 34 are each inserted into the aperture 74 of a respective one of the wings 72, thereby securing the veneer tie to the wall anchor 36. Positioning the pintle connectors 50 of the veneer tie 34 in the wings 72 has the effect of spreading stresses acting on the outer wythe 20 to avoid pin-point loading, or loading of the stresses on a single point.

Collar 64 is rotatable about the anchor 36 to adjust the angular orientation of the apertures 70 that accommodate the veneer tie 34 to remove angular and height misalignments that may exist when the anchor is mounted on the inner wythe 14. However, rotation of the collar 64 about the anchor 36 is limited to one direction and prevents unintentional rotation of the collar. Rotation of collar 64 does not in the illustrated embodiment cause the collar to move longitudinally along the anchor 36.

Figure 7:
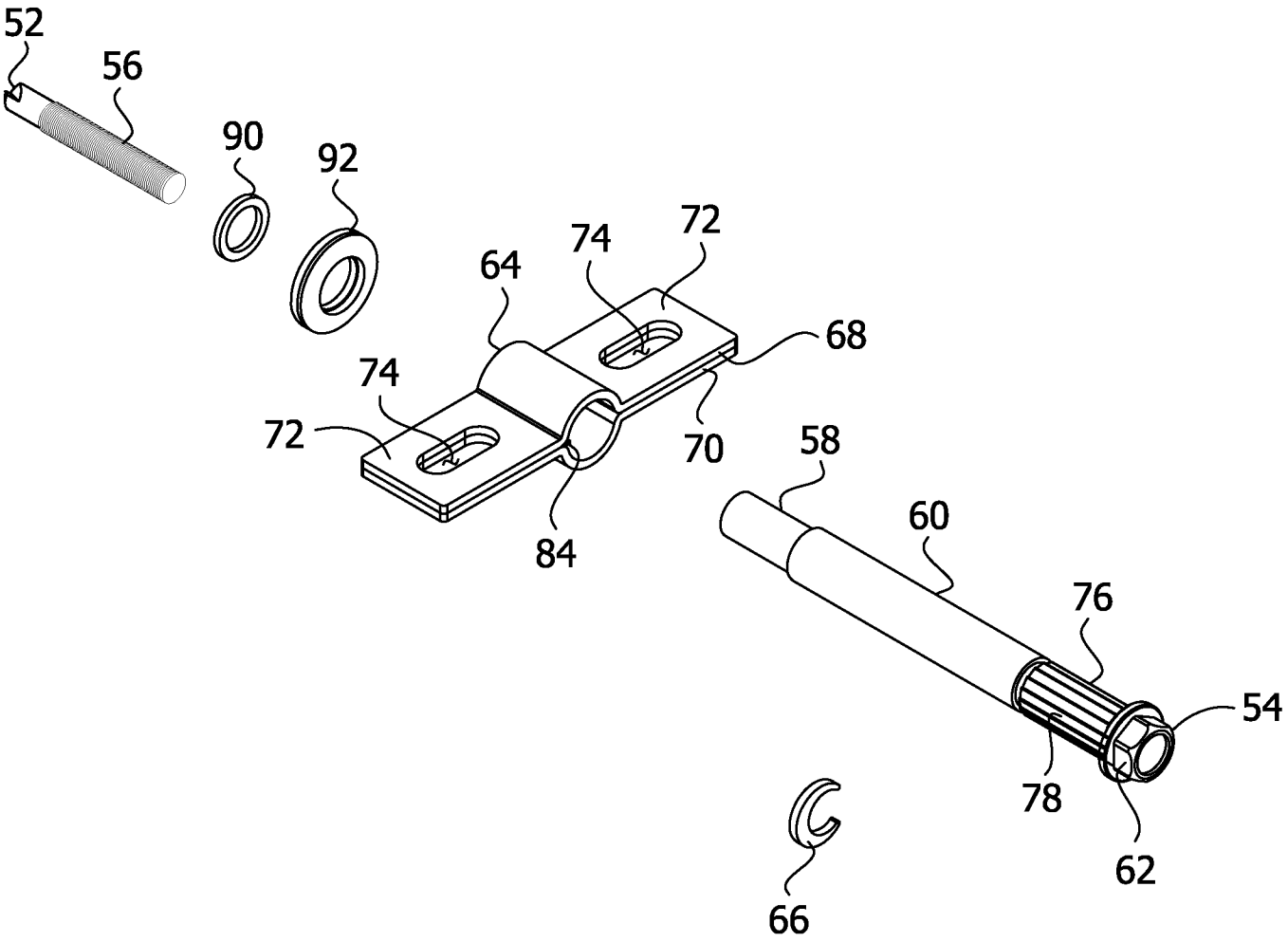
FIG. 7 is an exploded perspective of the anchor of FIG. 3.
Figure 8:
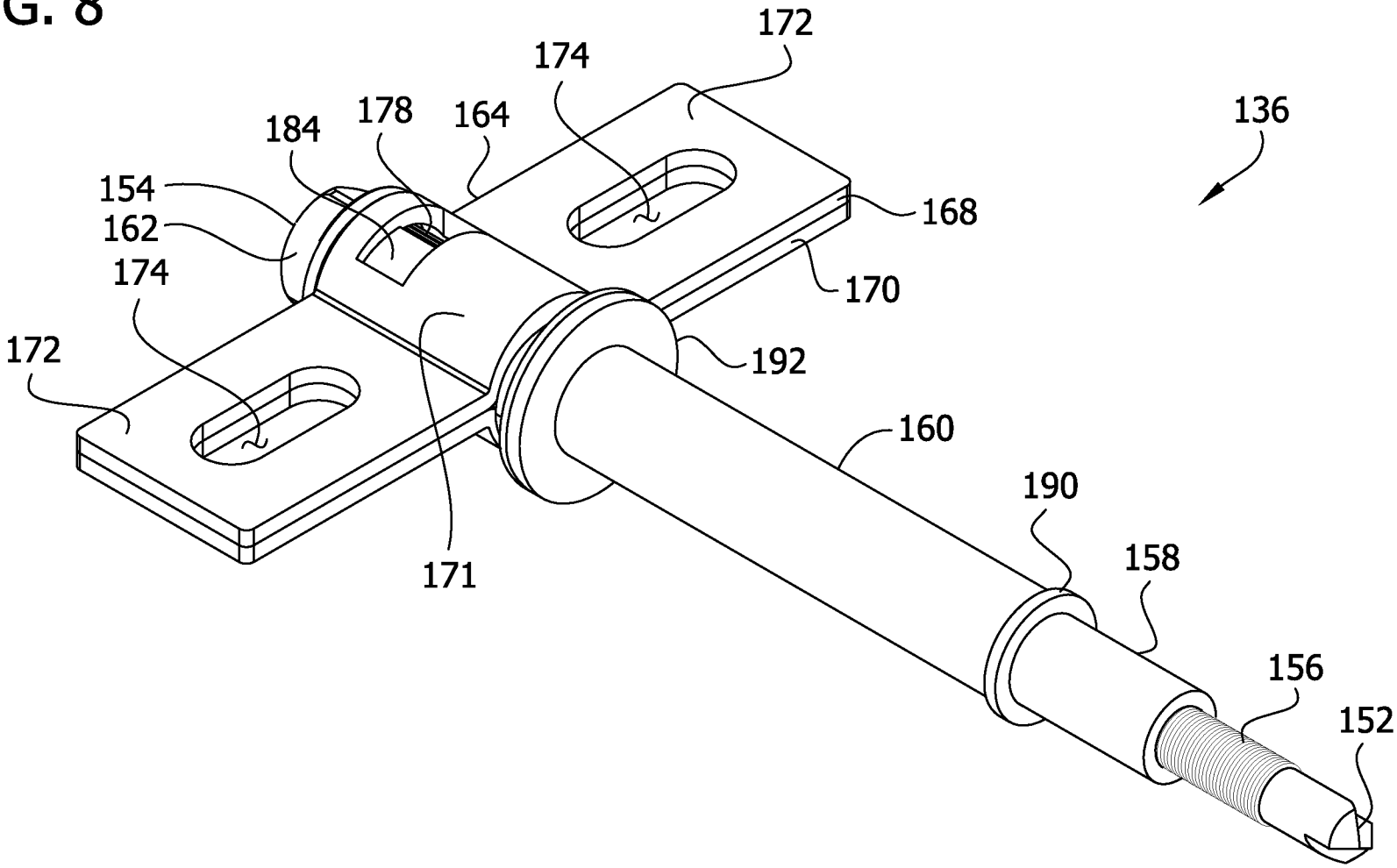
FIG. 8 is a perspective of an anchor with angular adjustment according to a second embodiment of the present invention.
Figure 9:
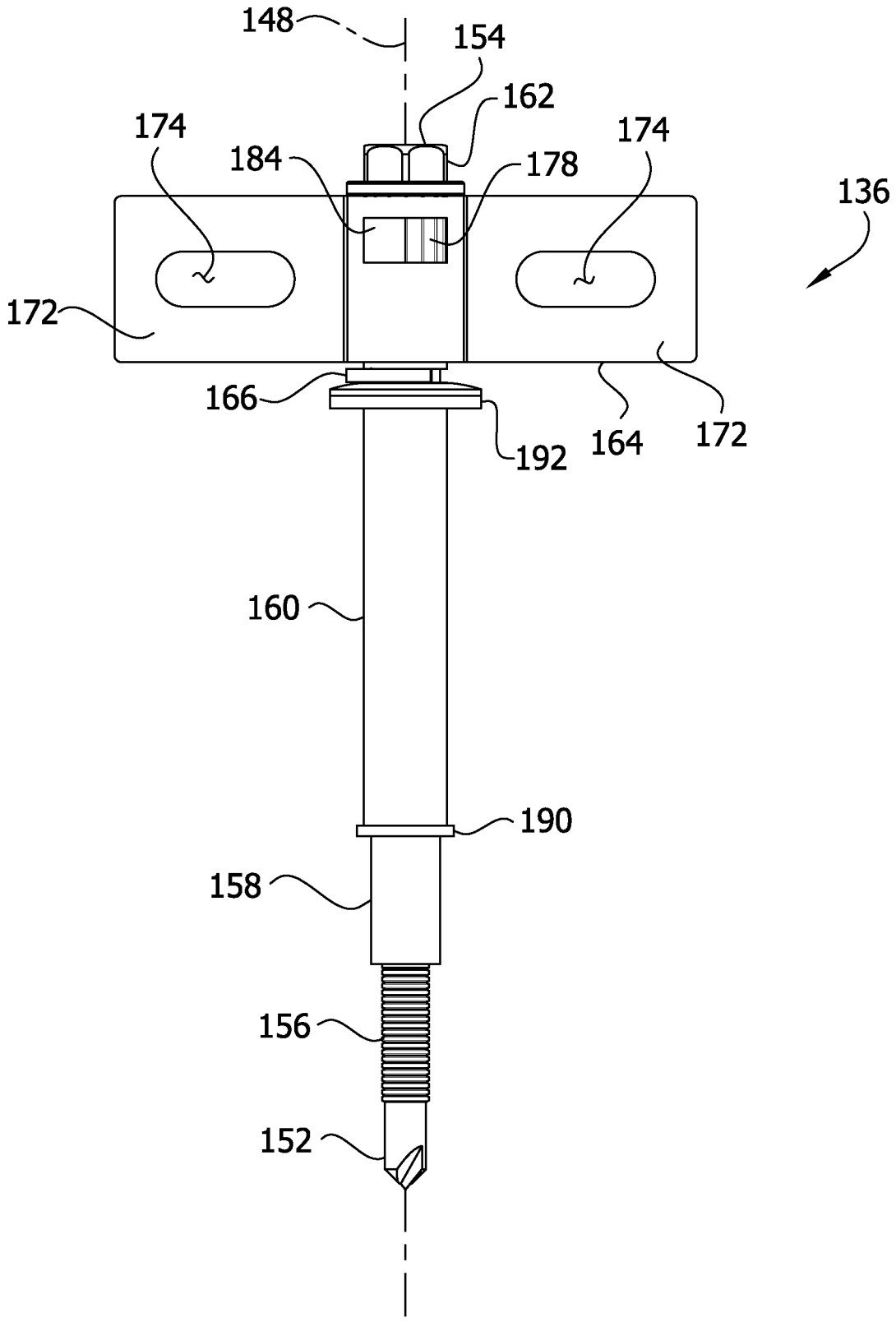
FIG. 9 is a top view thereof.

Rotation control structure of the anchor 36 limits rotation of the collar 64 about the longitudinal axis 48 of the anchor to only one direction. As shown in FIG. 7, the rotation control structure includes a rotation control portion 76 of the elongate body located between the second shaft portion 60 and the drive head 62. The rotation control portion 76 of the elongated body includes ratchet teeth 78 that are each elongate in the direction of the longitudinal axis 48 and extend a distance approximately equal to the height of the barrel 71. The rotation control portion 76 can extend over only part of the portion of the elongated body that receives the collar 64 within the scope of the present invention.

Figure 6:
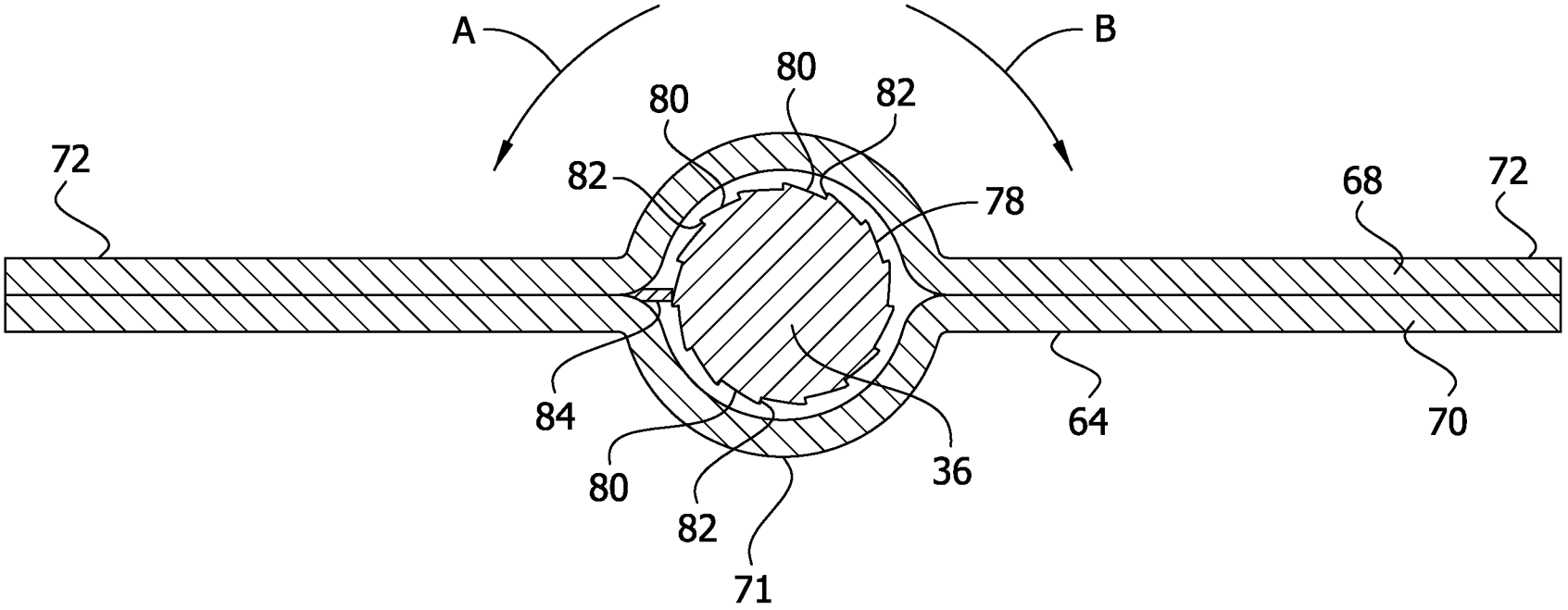
FIG. 6 is a section taken along line 6-6 of FIG. 5.

Referring to FIG. 6 it may be seen that the teeth 78 include gently sloping ramp portions 80 and steeply sloped stop portions 82 (see FIG. 6). The collar 64 has a tongue or pawl 84 secured between the first plate 68 and the second plate 70, such as by welding or other conventional means. The pawl 84 can be made of metal or any other suitable material, and can extend along the entire height of the barrel 71 or along only a portion of the barrel. The pawl 84 is positioned to engage the teeth 78 on the rotation control portion 76 of the elongated body. The teeth 78 and the pawl 84 are configured as an interengaging ratchet and pawl structure, so that the collar 64 can rotate about the anchor 36 in only one direction. When the collar 64 is turned in one direction, generally indicated by arrow A, the pawl 84 can be gradually deflected by the ramp portion 80 of the teeth 78 to allow the pawl to move past each tooth and the collar to turn. However, if a user attempts to turn the collar 64 in the opposite direction, generally indicated by arrow B, the pawl 84 will lock against one of the stop portions 82 of the teeth to prevent movement in that direction. In addition, the engagement of the pawl 84 with the teeth 78 provides a holding force that holds the collar 64 in a given rotation position against unintended movement even in the permitted direction.

Figure 2:
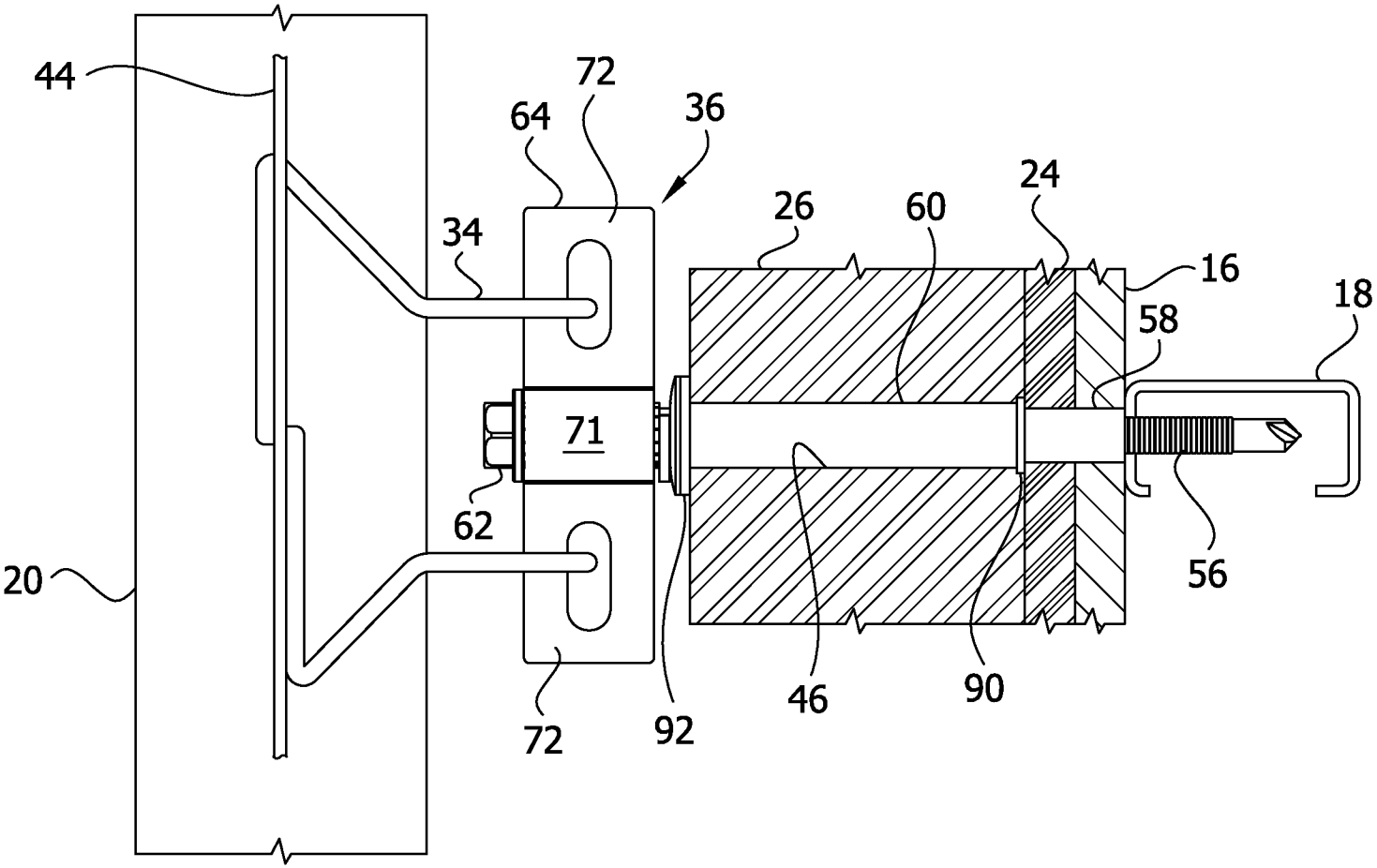
FIG. 2 is an enlarged, fragmentary elevation, partly in section, looking down from above on an anchoring system in use.

A wall anchor 36 according to the present invention can also include a dual seal system to prevent air and moisture penetration through the cavity wall structure 12. Preferably a stabilizing neoprene fitting or internal seal 90 is located at the junction of first and second shaft portions 58, 60. When fully driven into stud 18, the threaded portion 56 and first shaft portion 58 of wall anchor 36 pierce the sheetrock or wallboard 16 and air/vapor barrier 24, extending through an inner portion of anchor-receiving channel 46 (FIG. 2). The internal seal 90 covers the insertion point of the first shaft portion 58 and the threaded portion 56 through the inner channel portion, precluding air and moisture penetration through the channel and maintaining the integrity of air/vapor barrier 24.

Preferably, another stabilizing neoprene fitting or external seal 92 is located at the junction of the rotation control portion 76 and the second shaft portion 60. Upon installation of wall anchor 36 through rigid insulation 26, the larger barrel portion 60 has everywhere an interference fit inside the anchor-receiving channel 46, and presses the neoprene seal 90 against the outer surface of the barrier 24. Stabilization of this stud-type wall anchor 36 is attained by larger barrel portion 60 and internal neoprene seal 90 filling the space between the insulation 26 and the barrier 24, with external neoprene seal 92 capping the opening of the channel 46 into cavity 22 and clamping wall anchor 36 in place. This arrangement does not leave any end play or wiggle room for pin-point loading of the wall anchor and therefore does not loosen over time. With stabilizing fitting or external seal 92 in place, the insulation integrity within the cavity wall is maintained. A rigid washer (not shown) can be located adjacent the external seal 92 to protect the seal and provide a rigid reaction surface for the lock washer 66. It will be understood that the seal system may be omitted or have a different configuration than described within the scope of the present invention.

In producing wall anchor 36, the length of the smaller diameter first shaft portion 58 is dimensioned to match (or be only slightly longer than) the combined thickness of the air/vapor barrier 24 and the wallboard 16. Similarly, the length of the larger diameter second shaft portion plus the height of the internal seal 90 is dimensioned to match the thickness of insulation 26. This configuration allows for sealing of the anchor-receiving channels 46 upon insertion of wall anchors 36. However, other configurations of the anchor 36 do not depart from the scope of the present invention.

A second embodiment of a wall anchor having angular adjustment is illustrated in FIGS. 8-12. Wall anchor 136 is substantially similar to wall anchor 36 described above, with differences as pointed out herein. Corresponding parts of the anchor 136 will be given the same reference numbers as for the anchor 36, plus "100".

Wall anchor 136 includes an elongated body that extends along the longitudinal axis 148 of the anchor from a driven end 152 to a driving end 154. The driven end 152 includes a threaded portion 156. The elongated body of the wall anchor 136 includes a dual-diameter shaft with a smaller diameter first shaft portion 158 toward the driven end 152 and a larger diameter second shaft portion 160 toward the driving end 154.

A drive head 162 is located at the driving end 154 of the anchor 136. As illustrated, the drive head 162 is a bolt capable of being driven using a conventional chuck, and secures a collar 164 onto the anchor 136. A lock washer 166 holds the collar 164 in place on the elongated body. The collar 164 includes two plates 168, 170 secured together, such as by welding or other conventional means. Each of the plates is preferably made of metal or other suitable material. Other constructions of the collar, such as a collar formed from one plate or more that two plates, are within the scope of the present invention. The collar 164 includes a central barrel 171 and two wings 172 projecting in opposite directions from the barrel. Each wing defines an aperture 174 for receiving pintle connectors of a veneer tie, as described above. Collar 164, like collar 64 described above, is rotatable in one direction about the anchor 136 to adjust the angular orientation of the apertures 174 that accommodate the veneer tie to overcome slight angular and height misalignments between the wings 172 and the veneer ties.

Figure 10:
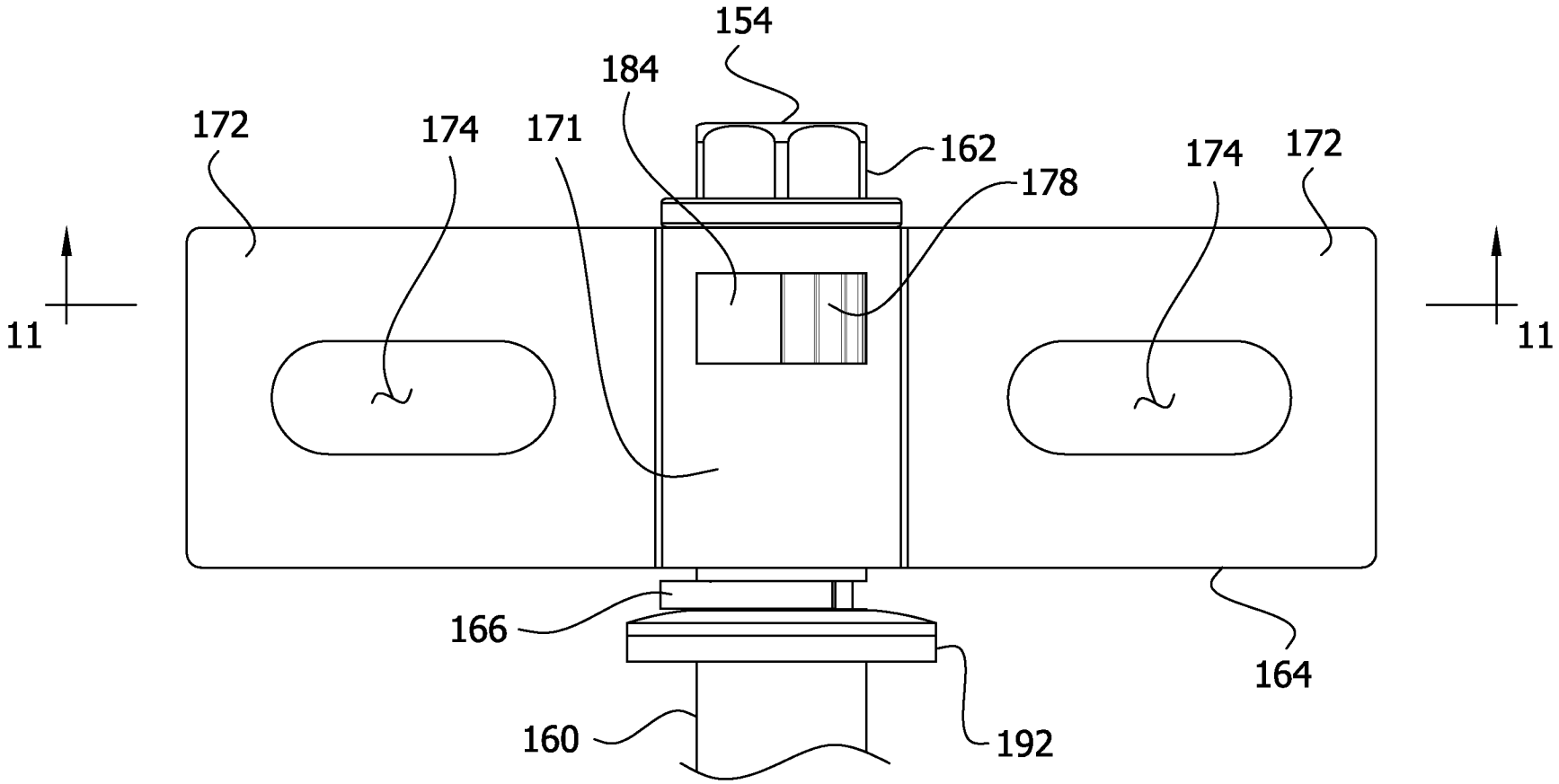
FIG. 10 is an enlarged fragmentary view of the anchor of FIG. 9.
Figure 11:
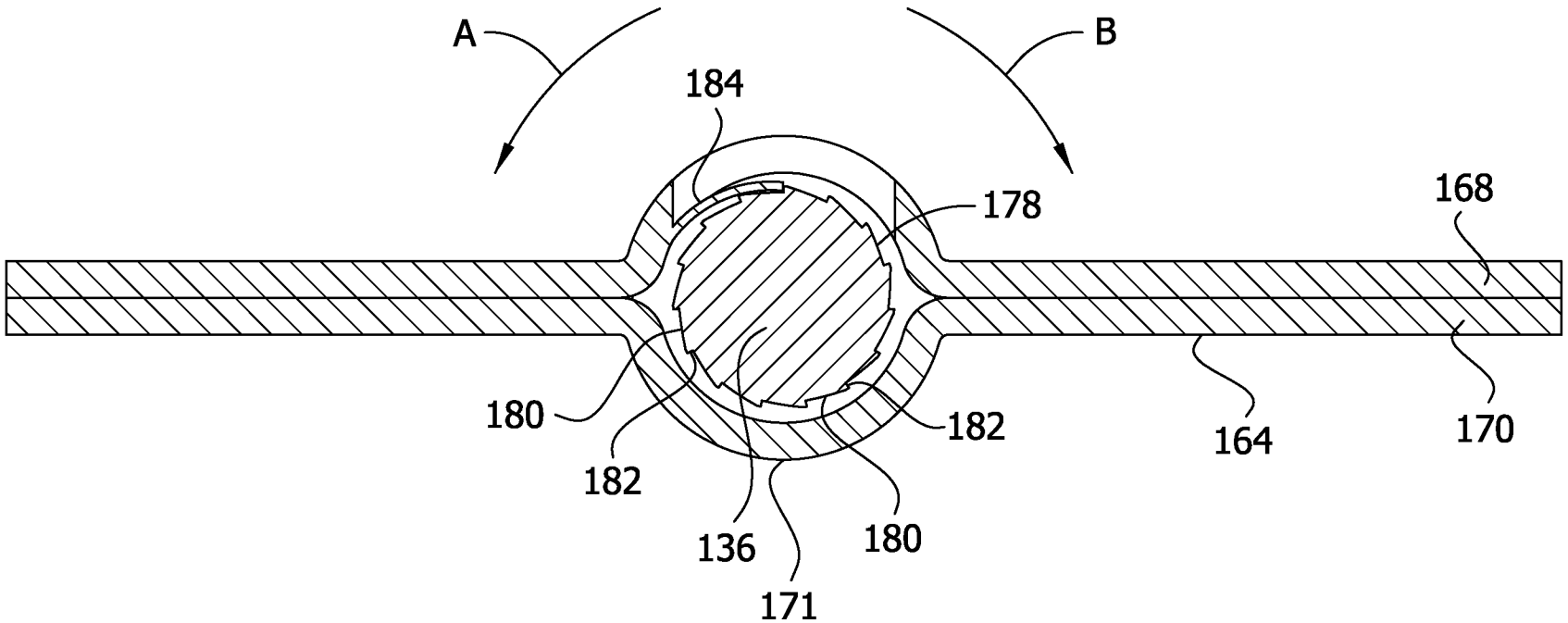
FIG. 11 is a section taken along line 11-11 of FIG. 10.
Figure 12:
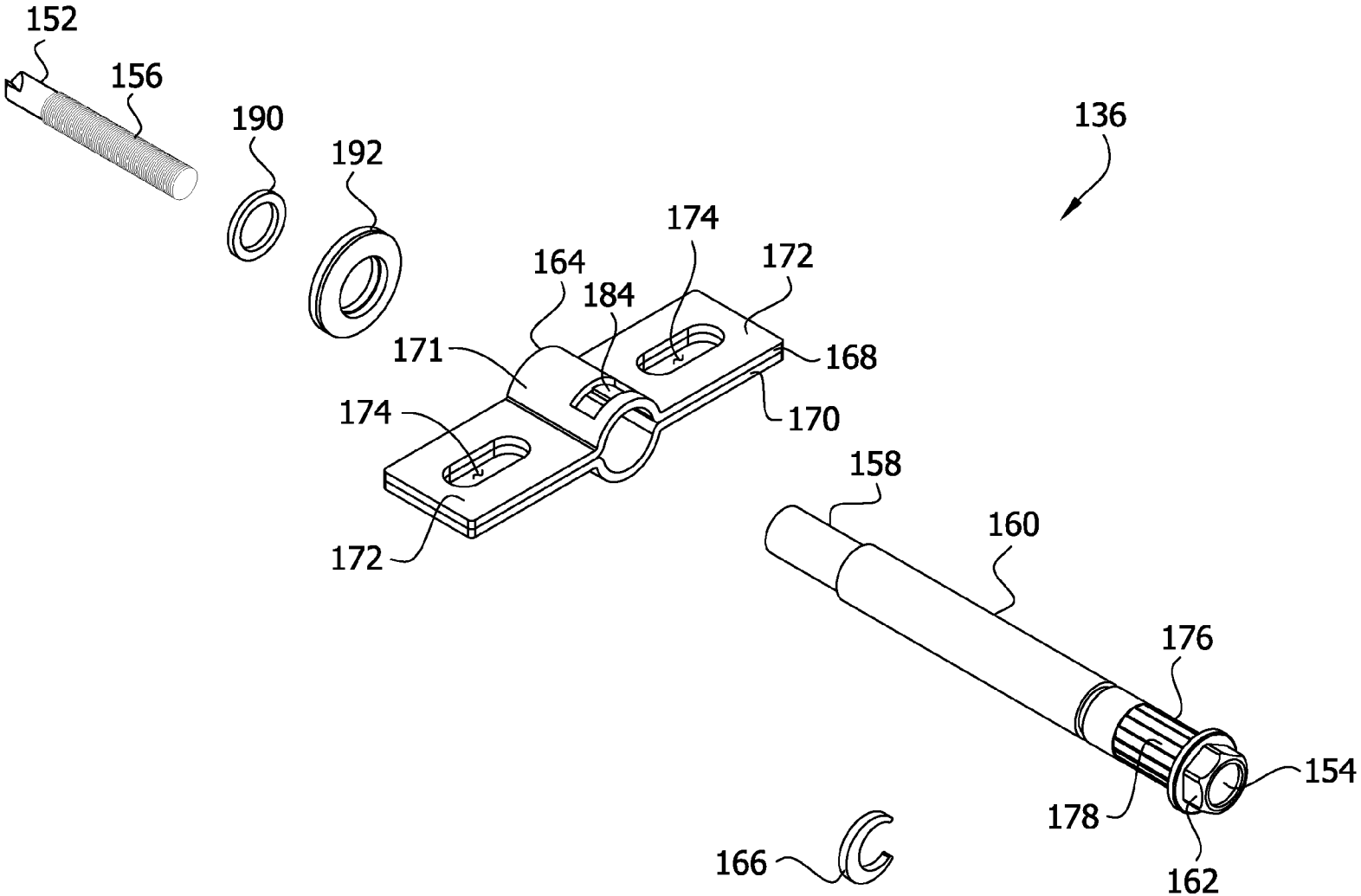
FIG. 12 is an exploded perspective of the anchor of FIG. 8.

Referring to FIGS. 10-12, rotation control structure of the anchor 136 limits rotation of the collar 164 about the longitudinal axis 148 of the anchor to only one direction. The elongated body of the anchor 136 has a rotation control portion 176 including teeth 178 having gently sloped ramp portions 180 and steeply sloped stop portions 182, as described above. Unlike the pawl 84 described above, the pawl in the 184 is formed by striking out a portion of the first plate 168 in the barrel 171 of the collar 164. The pawl 184 and the teeth 178 are configured as an interengaging ratchet and pawl structure that permits rotation of the collar 164 in only. Wall anchor 136 can also include seals 190, 192, which function as seals 90, 92, described above, to preclude air and moisture penetration and maintain the integrity of an air/vapor barrier upon installation of the anchor. It will be understood that the seal system may be omitted or have a different configuration than described within the scope of the present invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A wall anchor for use in a cavity wall to connect to a veneer tie to join an inner wythe and an outer wythe of the cavity wall, the wall anchor comprising:

an elongate body having a driven end, a driving end and a longitudinal axis; and a collar mounted on the elongate body for rotation about the longitudinal axis of the elongate body, the collar being adapted for connection to the veneer tie;

rotation control structure operatively engaging the collar and elongate body to permit rotation of the collar in a first direction relative to the elongate body about the longitudinal axis of the elongate body and to prevent rotation of the collar relative to the elongate body about the longitudinal axis of the elongate body in a second direction opposite the first direction;

the rotation control structure comprising ratchet teeth associated with one of the elongate body and the collar and a pawl associated with the other of the elongate body and the collar, wherein the ratchet teeth each extend in the direction of the longitudinal axis of the elongate body and project radially outwardly from the longitudinal axis.

2. The wall anchor of claim 1 wherein the ratchet teeth are formed on the elongate body and the pawl is mounted on the collar.

3. The wall anchor of claim 2 wherein the pawl projects from the collar.

4. The wall anchor of claim 3 wherein the pawl projects radially inward from the collar toward the longitudinal axis of the elongate body.

5. The wall anchor of claim 2 wherein the collar comprises a first metal plate and a second metal plate, the pawl being secured to the collar between the first and second metal plates.

6. The wall anchor of claim 5 wherein the pawl extends along an entire height of the collar.

7. The wall anchor of claim 2 wherein the collar comprises a first metal plate and a second metal plate, the pawl being formed by striking out a portion of the first metal plate.

8. The wall anchor of claim 1, wherein the collar and the elongate body are free of threaded connection.

9. The wall anchor of claim 1 wherein the collar includes wings projecting outwardly therefrom, each wing having an aperture for receiving a portion of the veneer tie to connect the veneer tie to the wall anchor.

10. A wall anchor for use in a cavity wall to connect to a veneer tie to join an inner wythe and an outer wythe of the cavity wall, the wall anchor comprising:

an elongate body having a driven end, a driving end and a longitudinal axis, the driven end being adapted to be threadedly mounted on the inner wythe of the cavity wall, the elongate body including a rotation control portion having ratchet teeth formed thereon, the ratchet teeth are each elongate in the direction of the longitudinal axis of the elongate body and project radially outwardly from the longitudinal axis; and a collar disposed on the elongate body and received on the rotation control portion, the collar having wings each having an aperture therein to receive a respective portion of the veneer tie, the collar comprising a first metal plate and a second metal plate, a pawl associated with the collar and projecting from the collar into engagement with the ratchet teeth, the pawl and ratchet teeth being positioned and configured for engagement with each other for permitting rotation of the collar about the longitudinal axis of the elongate body in a first direction and preventing rotation of the collar about the longitudinal axis of the elongate body in a second direction opposite the first direction.

11. The wall anchor of claim 10 wherein the pawl projects generally radially inward from the collar.

12. The wall anchor of claim 11 wherein the pawl is mounted between the first and second metal plates of the collar.

13. The wall anchor of claim 10 wherein the pawl comprises a portion of the first metal plate of the collar that is struck out to project toward the longitudinal axis of the elongate body.

14. The wall anchor of claim 10, wherein the elongate body comprises a first shaft portion located near the driven end and a second shaft portion located near the driving end, the first and second shaft portions being adjacent to each other.

15. The wall anchor of claim 10, wherein the second shaft portion has a substantially larger diameter than the first shaft portion.

16. The wall anchor of claim 14 further comprising an internal seal disposed on the elongate body at the junction of the first shaft portion and the second shaft portion, wherein the internal seal is adapted to seal a channel formed by insertion of the wall anchor into a wall, precluding water and vapor penetration therethrough.

17. The wall anchor of claim 10 further comprising an external seal disposed on the wall anchor adjacent a bottom surface of the collar, wherein the external seal is adapted to seal a channel formed by insertion of the wall anchor into a wall, precluding water and vapor penetration therethrough.

* * * * *